US006244475B1

(12) United States Patent
Walz et al.

(10) Patent No.: US 6,244,475 B1
(45) Date of Patent: Jun. 12, 2001

(54) HAIR TREATMENT DISPENSING CONTAINER

(76) Inventors: David K. Walz, 5279 Greencastle Way, Stone Mountain, GA (US) 30087; Frank Van Haltern, Jr., 1670 Montcliff Court, Decatur, GA (US) 30033

( * ) Notice: Subject to any disclaimer, the term of this patent is extended or adjusted under 35 U.S.C. 154(b) by 0 days.

(21) Appl. No.: 09/336,805

(22) Filed: Jun. 21, 1999

(51) Int. Cl.[7] ..... B67D 5/42
(52) U.S. Cl. ..... 222/387; 222/389; 222/402.22
(58) Field of Search ..... 222/95, 386.5, 222/387, 389, 402.21, 402.22, 386

(56) References Cited

U.S. PATENT DOCUMENTS 2,965,271 * 12/1960 Soffer et al. ..... 222/542
3,169,670 * 2/1965 Hrebenak et al. ..... 222/95
3,662,926 * 5/1972 Umstead ..... 222/95
4,171,757 * 10/1979 Diamond ..... 222/389
4,271,991 * 6/1981 Diamond et al. ..... 222/389
4,685,597 * 8/1987 Hirao et al. ..... 222/389
5,423,454 * 6/1995 Lippman et al. ..... 222/1
5,522,526 * 6/1996 DeLaforcade et al. ..... 222/1
5,577,641 * 11/1996 DeLaforcade et al. ..... 222/386
5,848,598 12/1998 Walz et al. .
6,019,252 * 2/2000 Benecke et al. ..... 222/95

* cited by examiner

*Primary Examiner*—Kevin Shaver
*Assistant Examiner*—Melvin A. Cartagena
(74) *Attorney, Agent, or Firm*—Rodgers & Rodgers

(57) ABSTRACT

A relaxer and straightener dispensing container comprising a cylinder having a top and bottom interconnected therewith to form an airtight container, a valve associated with the top and comprising a hollow tube, a sleeve disposed in coaxial relationship with the hollow tube, the sleeve having a collar extending downwardly therefrom, a top piece associated with the top and coaxially disposed with respect to the hollow tube, and a flange extending outwardly from the collar and disposed in an interlocking relationship with the top.

2 Claims, 5 Drawing Sheets

HAIR TREATMENT DISPENSING CONTAINER

BACKGROUND OF THE INVENTION

This invention relates to the packaging and dispensing of hair straightener or relaxer chemicals of a non-lye or a lye-type and more specifically to the dispensing of these chemicals from a pressurized container. One problem is possible chemical reaction between the propellent and the straightener or relaxer.

In order to provide a barrier between hair relaxer/straightener and the gas used to pressurize the container, a bag has been used to contain the straightener relaxer thereby providing mechanical separation of the propellent and the straightener/relaxer.

Due to the chemically active nature of the straightener/relaxer, a chemical reaction may occur between the straightener/relaxer and any metal parts of the container dispensing system.

SUMMARY OF THE INVENTION

A relaxer and straightener dispensing container comprising a cylinder having a top and bottom interconnected therewith to form an airtight container, a valve associated with the top and comprising a hollow tube, a protective sleeve disposed in coaxial relationship with the hollow tube, and the sleeve having a flange extending outwardly therefrom and disposed in an interlocking relationship with the top.

DESCRIPTION OF THE PREFERRED EMBODIMENTS

Figure 1:
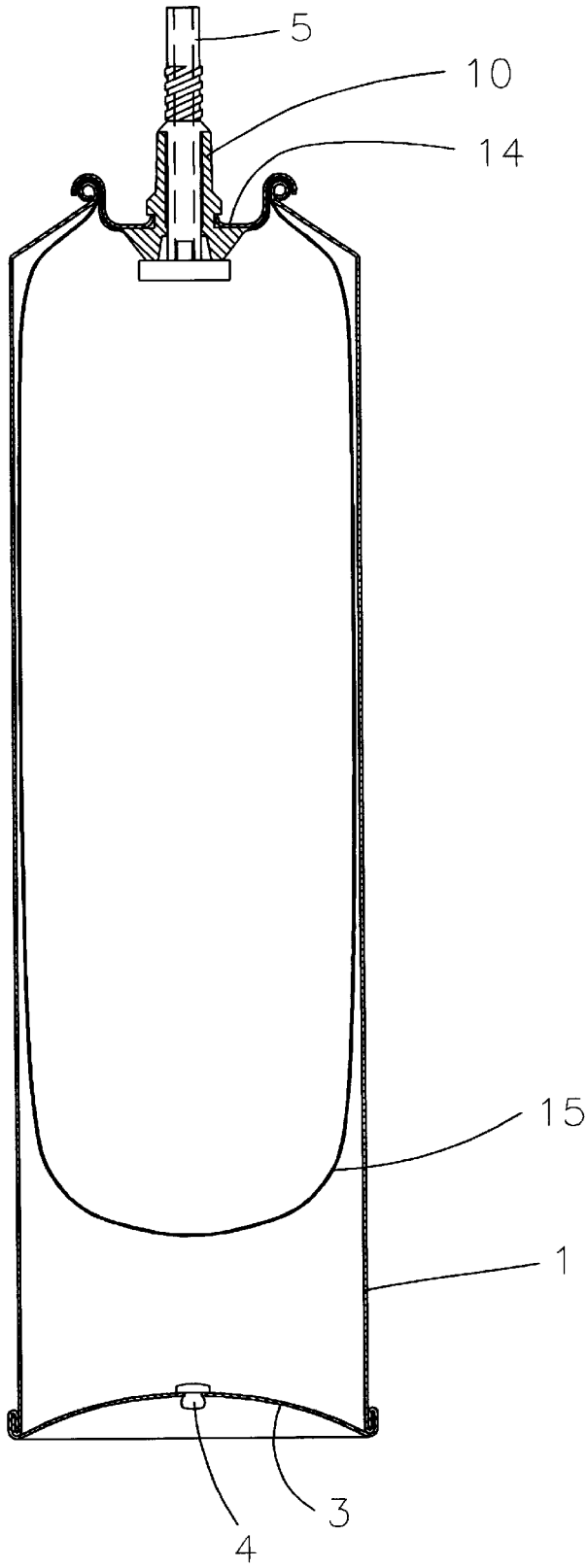
FIG. 1 is a cross-sectional view of a hair treatment chemical dispensing container according to one form of this invention.

In the drawings, the numeral 1 designates the elongated cylindrical element of the hair treatment dispensing container, the top which is defined by outwardly curved rim 2. Bottom 3 is joined to the lower edge of cylinder 1. Seal 4 is disposed in an aperture in bottom 3 as is well known in the art.

The chemical dispensing valve means for the container is formed in part by means of hollow tube 5 which may or may not have ribs 6 formed thereon and which is integrally joined along the bottom edge thereof to base 7. Immediately above base 7, aperture 8 is formed in hollow tube 5. finally, outwardly projecting ridge 9 is formed on hollow tube 5.

Figure 2:
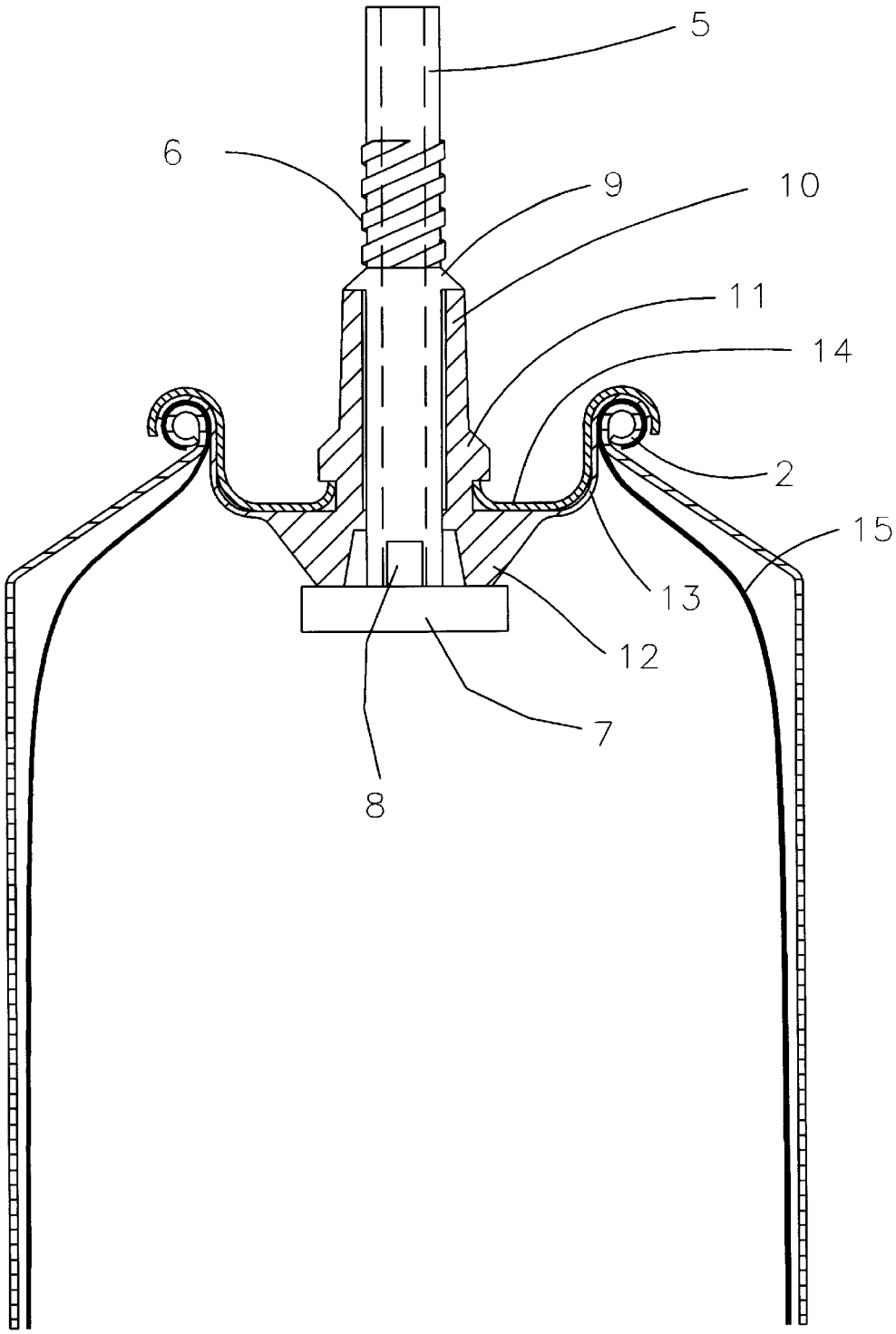
FIG. 2 is an enlarged cross-sectional view of the top portion of the container shown in FIG. 1.

According to this invention, flexible sleeve 10 is provided and is coaxially disposed with respect to hollow tube 5 and is provided with outwardly projecting rim 11 and downwardly projecting collar 12. To complete sleeve 10, outwardly and upwardly projecting flange 13 is integrally connected to flexible collar 12 and the outer edge thereof is curved outwardly and downwardly as best shown in FIG. 2.

In the completed container, the upper edge of sleeve 10 is disposed in abutting relationship with ridge 9 and the lower edge of collar 12 is disposed in abutting relationship with the upper surface of base 7. Finally, circular top piece 14 is provided, the inner edge of which is disposed in an abutting relationship with the lower edge of rim 11 and the outer edge thereof is disposed in overlapping curved relationship with respect to flange 13.

According to one form of this invention, bag 15 is provided and is disposed interiorly of cylinder 1 with the top portion thereof sandwiched between and in an airtight relationship with top piece 14, flange 13 and curved rim 2 of cylinder 1. It can be seen that with hair straightener or relaxer contained in bag 15, none of the relaxer comes in contact with the metal inner surface of cylinder 1 or the metal inner surface of top piece 14.

As is well known, propellant is injected into cylinder 1 through the aperture in bottom 3 and then sealed within the container by means of seal 4. In use, hollow tube 5 is manually deflected causing base 7 to separate from its abutting relationship with flexible collar 12 of sleeve 10 thereby allowing hair relaxer, which is under pressure, to enter aperture 8 and be dispensed through hollow tube 5.

Figure 3:
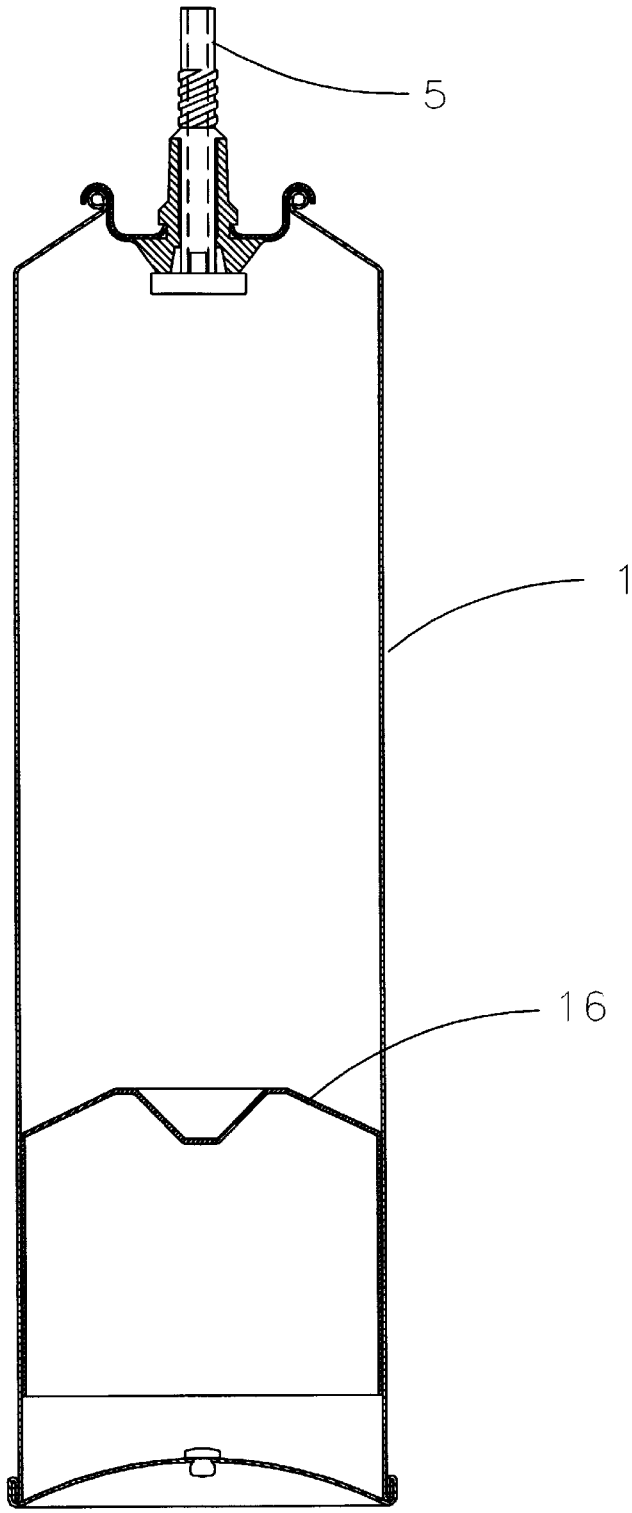
FIG. 3 is a cross-sectional view of an alternate form of the invention and depicts another method of mechanically separating the propellent from the straightener or relaxer.
Figure 4:
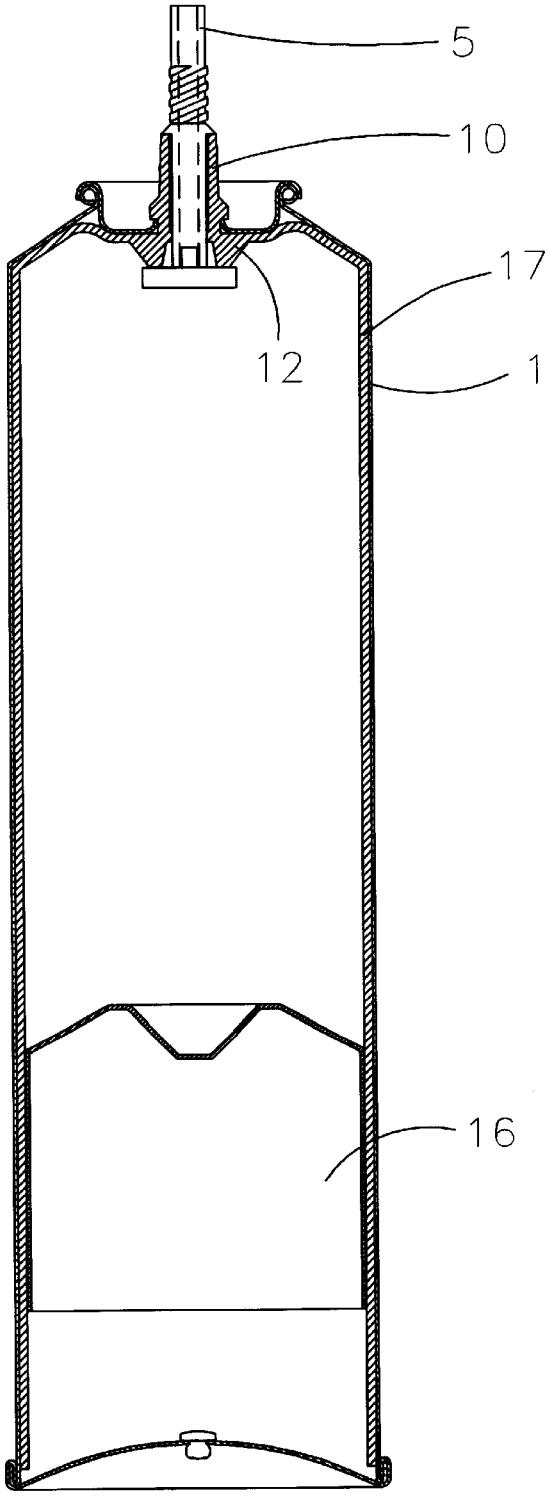
FIG. 4 is an enlarged cross-sectional view of an alternative form of the invention, and provides a barrier between the metal parts of the container and the hair straightener/relaxer.
Figure 5:
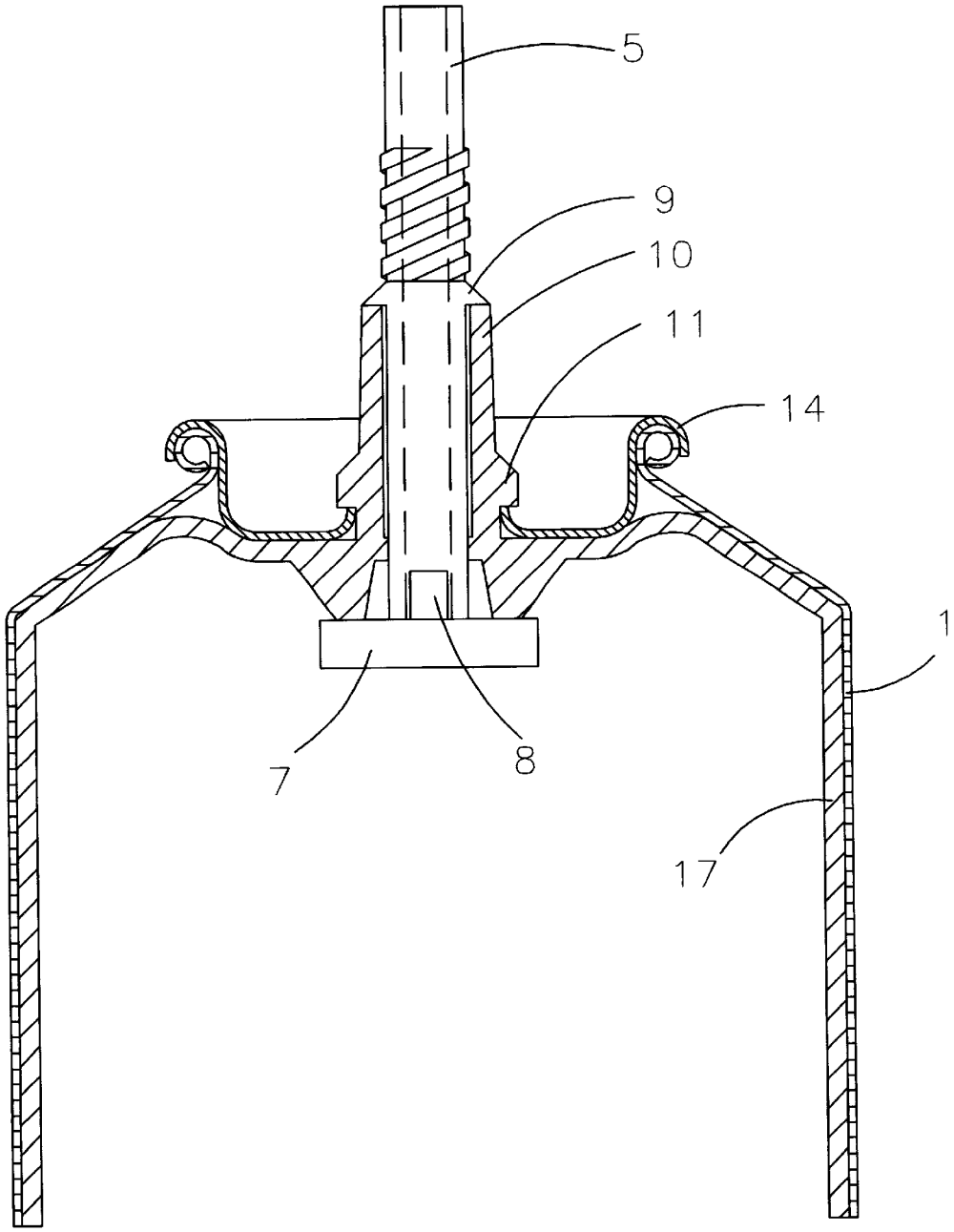
FIG. 5 is an enlarged cross-sectional view of the top portion of the container shown in FIG. 4.

A modified form of the invention is shown in FIGS. 3 and 4 and 5, the basic elements of which are the same as that shown and described in connection with the dispensing container shown in FIGS. 1 and 2. The modification resides in the propellant means which is defined in part by piston 16 wherein the hair relaxing chemical is disposed within cylinder 1 above piston 16. The propellant is injected into cylinder 1 below piston 16 in the same manner as described in connection with the container shown in FIGS. 1 and 2. As piston 16 is urged upwardly by the propellant, hair relaxer is dispensed, as previously described, through hollow tube 5.

In FIG. 3, the inner surface of metal top piece 14 and metal cylinder 1 may be coated with a thin film of plastic material by any known means such as spraying and the like.

In order to better protect the hair relaxer from the inner surface of metal top piece 14 and metal cylinder 1, protective insert 17 is provided and extends outwardly from collar 12 into flat face contacting relation with the inner surface of cylinder 1 and then extends to the bottom of cylinder 1, as best shown in FIG. 4. Protective insert 17 is injection molded of soft plastic material such as silicone rubber, polyethylene or polypropylene.

In FIG. 3, the inner surface of metal cylinder, is coated with a thin film of plastic material by any known means such as spraying and the like.

By this means, the hair relaxer is protected from contact with the inner surface of metal cylinder 1 and the inner surface of metal top piece 14 at all times during storage and the dispensing operation.

What is claimed is:

1. A dispenser for hair relaxer comprising a metal cylinder having top and bottom portions interconnected to form an airtight container, said hair relaxer disposed in said container, valve means associated with said top portion, said valve means comprising a hollow tube whereby activation of said valve causes said chemical to be dispensed through said hollow tube, a sleeve coaxially disposed and in face contacting relation with respect to said hollow tube and being connected to said top portion, said sleeve at least partially disposed between said top and bottom portions, a protective insert integrally joined to said sleeve and extending downwardly therefrom in face contacting relation with the inner surface of said metal cylinder, and a piston disposed within said cylinder and in face contacting relation with the inner surface of said protective insert.

2. A dispenser according to claim 1 wherein the inner surface of said cylinder is coated with plastic material.

* * * * *